US011712609B2

(12) United States Patent
Dunford et al.

(10) Patent No.: US 11,712,609 B2
(45) Date of Patent: Aug. 1, 2023

(54) TRAINING APPARATUS AND METHOD FOR BALL HITTING

(71) Applicants: Abigail C Dunford, Brownsboro, AL (US); AnnMarie K Dunford, Brownsboro, AL (US); Russell L Dunford, Brownsboro, AL (US)

(72) Inventors: Abigail C Dunford, Brownsboro, AL (US); AnnMarie K Dunford, Brownsboro, AL (US); Russell L Dunford, Brownsboro, AL (US)

( * ) Notice: Subject to any disclaimer, the term of this patent is extended or adjusted under 35 U.S.C. 154(b) by 565 days.

(21) Appl. No.: 16/195,768

(22) Filed: Nov. 19, 2018

(65) Prior Publication Data

US 2019/0083872 A1 Mar. 21, 2019

(51) Int. Cl.

| | |
|---|---|
| ***A63B 69/00*** | (2006.01) |
| ***A63B 69/38*** | (2006.01) |
| ***A63B 1/00*** | (2006.01) |
| *A63B 102/02* | (2015.01) |
| *A63B 102/18* | (2015.01) |
| *A63B 102/20* | (2015.01) |

(52) U.S. Cl.

CPC ..... *A63B 69/0091* (2013.01); *A63B 1/00* (2013.01); *A63B 69/0002* (2013.01); *A63B 69/0015* (2013.01); *A63B 69/0095* (2013.01); *A63B 69/38* (2013.01); *A63B 2069/0008* (2013.01); *A63B 2102/02* (2015.10); *A63B 2102/18* (2015.10); *A63B 2102/182* (2015.10); *A63B 2102/20* (2015.10); *A63B 2209/00* (2013.01); *A63B 2220/40* (2013.01); *A63B 2220/53* (2013.01); *A63B 2220/805* (2013.01); *A63B 2220/833* (2013.01); *A63B 2225/50* (2013.01); *A63B 2243/0095* (2013.01)

(58) Field of Classification Search

CPC ... A63B 69/0091; A63B 1/00; A63B 69/0002; A63B 69/0015; A63B 69/0095; A63B 69/38; A63B 2102/02; A63B 2102/18; A63B 2102/182; A63B 2102/20; A63B 2069/0008; A63B 2220/40; A63B 2220/53; A63B 2220/805; A63B 2220/833; A63B 2225/50; A63B 2243/0095

USPC ..... 473/422, 458, 437, 219, 226, 256, 453, 473/450, 461, 433, 457, 451, 423, 424; D21/725

See application file for complete search history.

(56) References Cited

U.S. PATENT DOCUMENTS 2,765,170 A * 10/1956 Brown ..... A63B 69/0091 473/424
3,270,564 A * 9/1966 Evans ..... A63B 69/3632 73/865.4

(Continued)

*Primary Examiner* — Mitra Aryanpour
(74) *Attorney, Agent, or Firm* — Patent Grove AB; Tomas Friend

(57) ABSTRACT

A ball hitting practice device includes a shaft having a target at a distal end, a grip at a proximal end, an accelerometer, a microprocessor, and a way of providing feedback to a person hitting the target. A ball hitting practice system includes a ball hitting practice device and a computing device wirelessly communicating with the ball hitting practice device. A method for practicing ball hitting involves striking the target of a ball hitting practice, transferring timed acceleration data to the computing device, correlating ball hitting parameters with a training condition and displaying the correlated ball hitting parameter in a display.

18 Claims, 3 Drawing Sheets

(56) References Cited

U.S. PATENT DOCUMENTS 3,717,857 A * 2/1973 Evans ..... A61B 5/1107 340/870.13
4,022,467 A * 5/1977 Ruess ..... A63B 69/0091 473/464
4,513,965 A * 4/1985 Aschermann ..... A63B 69/0002 473/458
5,056,783 A * 10/1991 Matcovich ..... A63B 69/0024 473/453
5,230,506 A * 7/1993 Cipriano ..... A63B 69/0091 473/424
5,492,321 A * 2/1996 Cipriano ..... A63B 69/0002 473/424
5,755,631 A * 5/1998 Paschka ..... A63B 69/0095 473/424
D413,641 S * 9/1999 Falco ..... D21/725
6,435,989 B1 * 8/2002 Grubman ..... A63B 69/0002 473/422
6,640,200 B1 * 10/2003 Baum ..... A63B 24/0021 702/142
6,786,841 B1 * 9/2004 Dixon ..... A63B 69/0002 473/424
7,297,078 B2 * 11/2007 Libonati ..... A63B 15/005 473/457
7,775,911 B2 * 8/2010 Zappel ..... A63B 69/0002 473/422
8,128,516 B2 * 3/2012 Pan ..... A63B 69/0091 473/427
8,753,233 B2 * 6/2014 Lay ..... A63B 69/0075 473/451
8,827,846 B2 * 9/2014 Shocklee ..... A63B 69/0002 473/453
8,827,847 B2 * 9/2014 Johnson ..... A63B 69/3632 473/232
9,757,635 B1 * 9/2017 Sorenson ..... A63B 69/36 473/458
2002/0134153 A1 * 9/2002 Grenlund ..... A63B 71/0619 73/493
2006/0014597 A1 * 1/2006 Cantu ..... A63B 69/0002 473/422
2009/0221388 A1 * 9/2009 Giannetti ..... A63B 69/0002 473/457
2011/0077107 A1 * 3/2011 Deer ..... A63B 69/0002 473/437
2011/0224012 A1 * 9/2011 Hashimoto ..... A63B 69/3632 473/223
2012/0244969 A1 * 9/2012 Binder ..... H05K 999/99 473/570
2014/0228141 A1 * 8/2014 Sakyo ..... A63B 24/0006 473/223
2014/0274486 A1 * 9/2014 Thurman ..... A63B 60/46 473/451
2015/0057111 A1 * 2/2015 Tremblay-Munger ..... A63B 69/0026 473/446
2015/0202510 A1 * 7/2015 Appleton ..... A63B 69/00 473/446
2015/0290514 A1 * 10/2015 Knight ..... A63B 69/0002 473/453
2015/0352405 A1 * 12/2015 Toronto ..... G09B 5/04 473/457
2016/0151666 A1 * 6/2016 Bentley ..... A63B 24/0003 473/223
2016/0158619 A1 * 6/2016 Polstein ..... A63B 60/46 473/457
2018/0021653 A1 * 1/2018 Thornbrue ..... G01C 21/00 473/453
2019/0154723 A1 * 5/2019 Kacyvenski ..... A61B 5/389 702/182

* cited by examiner

TRAINING APPARATUS AND METHOD FOR BALL HITTING

BACKGROUND OF THE INVENTION

Field of the Invention

The present invention relates to apparatus and methods for bat swinging practice including visual, haptic, and/or audible feedback.

Discussion of Related Art

Many devices have been developed over the years to act as batting aids to help people improve their batting skills.

For example, U.S. Pat. No. 3,921,976 describes a batting aid with a handle and a resilient head attached the end of the handle. The head is elastic with a Shore Hardness of around 60. In use, the batting aid is held by the handle the head directed toward the batter while the batter swings a bat to make contact with the head.

U.S. Pat. No. 4,846,472 also describes a hand held baseball batting aid with a rigid handle. The handle has a flexible, tubular extension with an outer open end. A flexible retention member extends within the tubular extension with one end attached at the handle and the other end end attached to a target object. The flexible member exerts a tension force which holds the target object in the open end of the tubular extension and absorbs some of the shock transmitted to a person holding the handle when the target is struck by a bat.

U.S. Pat. No. 5,230,506 describes a batting practice device having a handle and a flexible member connected to opposite ends of a tubular shaft and a spherical target connected to the flexible member at a target end of the training device. The spherical target is made of a shock absorbing material and the handle has a gripping portion positioned between a front and a rear flange. The structure of the device is designed to reduce the shock and torque experiences by a person holding the handle when the target is struck by a bat.

U.S. Pat. No. 5,492,321 describes a telescoping batting practice device comprising a stiff tubular member with a handle on one end and an opening containing a ball-supporting member at the other end. The ball-supporting member slides in a telescopic manner in the interior of the tubular member, with a ball tightly attached to the outer end of the ball-supporting member. A locking collar is used to retain the ball-supporting member in either a compacted or extended position.

U.S. Pat. No. 6,786,841 describes a hand-held batting practice device made of a resilient semi-flexible rod with a handle attached at one end and a ball simulator attached on the other end. The device includes an anchor strap that encircles one of the hands of a person holding the device by the handle. A trainer not holding the device observes a batter swinging at the ball simulator may make suggestions for how the batter can improve his or her technique.

U.S. Pat. No. 8,753,233 describes a swing training device comprising a cover attached to a sheath, wherein the color of the target contrasts with the color of a protective end of the sheath. A safety anchor keeps the sheath attached to the device. The device can be hand held or attached to a stand.

US 2006/0014597 describes a batting aid device comprising shock-absorbent lightweight components, with a handle at one end and a golf-size ball at the other. The device is designed so that a user does not experience fatigue from the weight of the apparatus or repeated impacts of a bat.

US 2006/0287137 describes a virtual environment for users to practice batting, kicking and/or throwing skills without the need for another person while providing users with instantaneous feedback to users and other participants. The environment provides controllable speed, angle, spin and pitching sequence of incoming balls. When a hit ball strikes particular zones, sensors in these zones can provide different reactions depending on the location of impact. including baseball and football stadiums, soccer and cricket fields, golf courses, frisbee US 2007/0238556 describes a tennis swing training device that provides a proper "feel" to correctly condition the tennis swing of a tennis player. The device comprises a long, flexible shaft with a handle at one end and a target at the other.

Despite numerous inventions designed to help train batters to improve their batting skills, the need for an easily used, affordable batting trainer that automatically provides consistent and useful feedback in near real time remains. None of the existing batting trainer devices provides reliable feedback to the batter with respect to locations on the ball or target object that is contacted by the bat, or the acceleration forces that are generated within the target ball when struck by the bat. Neither are the existing devices capable of tracking a batter's progress over time or storing or displaying data regarding parameters associated with a batter's hitting. It is accordingly an object of the present invention to ameliorate the above limitations associated with existing training aids or at least to provide an alternative to existing devices and systems designed to help a person improve his/her batting skills.

BRIEF SUMMARY OF THE INVENTION

In one aspect, the present invention provides an interactive bat training device comprising a target region, an accelerometer, a microprocessor, and a feedback indicator. In another aspect, the invention provides a system for batting training comprising an interactive bat training device and a computing device comprising a display. In yet another aspect, the inventions provides a method for improving batting ability using a device or a system according to the invention.

BRIEF DESCRIPTION OF THE DRAWINGS

The elements of the drawings are not necessarily to scale relative to each other, with emphasis placed instead upon clearly illustrating the principles of the disclosure. Like reference numerals designate corresponding parts throughout the several views of the drawings in which.

DETAILED DESCRIPTION OF THE INVENTION

Figure 1:
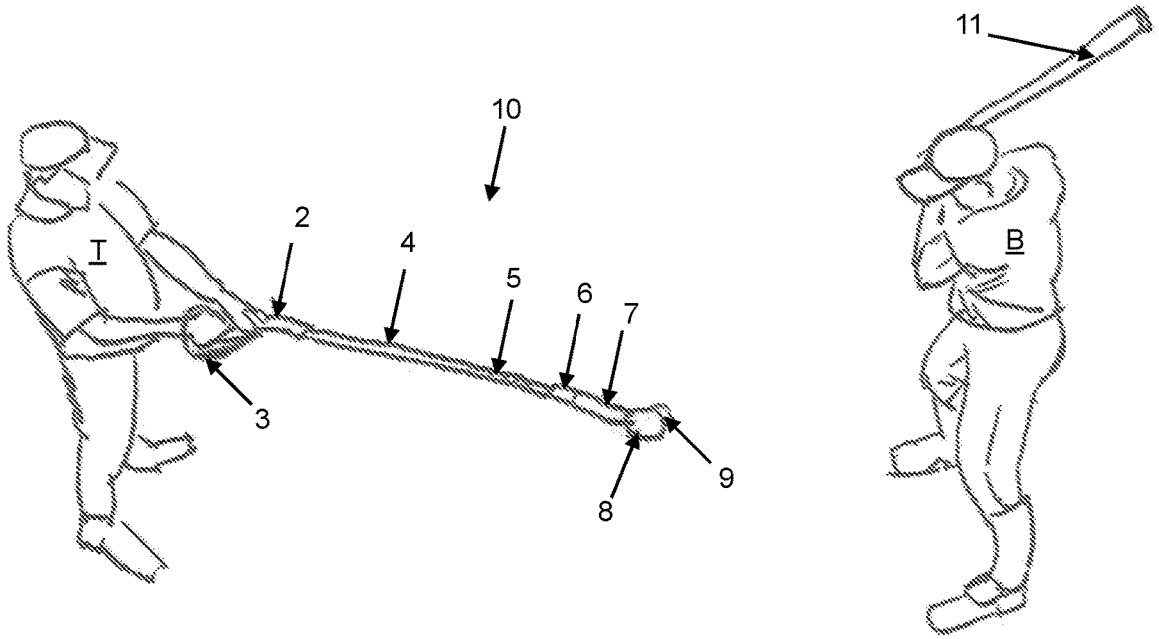
FIG. 1 is a perspective view of an embodiment of a bat training device in use.

Specific embodiments of the invention are described with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. The invention is described using the example of baseball batting practice. The invention, however, also applies to other sports such as softball, cricket, tennis, and volleyball. In the drawings, like numbers refer to like elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Referring to FIG. 1, a training apparatus or device (10) for practicing ball hitting may be held by a trainer, or target holder, T for a ball hitter B. In FIG. 1, ball hitter B is shown as using a bat (11) to strike a target (8) having the size and shape of a baseball. Alternatively, the training device (10) may be attached to a stand or other support structure so that the target (8) is in a position to be struck by the bat (11) so that no target holder T is required. Training devices (10) for softball and cricket have targets (8) having the size and shape of a softball and cricket ball, respectively. A training device (10) for tennis has a target (8) having the size and shape of a tennis ball, which is struck by a ball hitter B swinging a tennis racket. A training device (10) for volleyball has a target (8) having the size and shape of a volleyball struck by a ball hitter B with their hand(s). As with baseball training embodiments, training devices (10) for other ball hitting sports may be clamped, clipped, tied, or otherwise fastened to a stand or other support so that the device (10) may be used without the need for a target holder T.

The training device (10) comprises a shaft (4) extending from a handle grip (2) at its proximal end to a target (8) at its distal end. The shaft (4) is preferably made of fiberglass, which provides a desired flexibility and strength allowing the target to be hit many times with the shaft flexing and rebounding to its original shape without being damaged. Embodiments of the shaft (4) shown in the figures are straight but the shaft (4) may be curved and oriented with the concave side of the arc of curvature facing the ball hitter B. Such an embodiment may be advantageous for tennis training embodiments because the distance between the sweet spot of the racket and the racket frame may cause the frame to strike the shaft (4). The shaft (4) may be comprised of composite materials comprising fiberglass, carbon fiber, Kevlar, a polyester resin, an epoxy resin, and combinations of these. Other materials from which the shaft may be comprised include bamboo, aluminum, and durable plastic such as a polyvinyl chloride or a polycarbonate. The shaft (4) preferably has a circular cross-sectional shape, but the cross sectional shape may be square, rectangular, oval, hexagonal, or combinations of these and variable along its length. The shaft diameter is preferably from ¼" to 1" for a baseball training embodiment. For a volleyball training embodiment, the shaft (4) may be larger in diameter and for a tennis training embodiment, the diameter mat be smaller. The precise length of the shaft (4) from the proximal end of the grip (2) to the target (8) is not critical but a length of from about 6 feet to about 7 feet or about 1.8 to about 2.2 meters is preferred so that the risk of striking the target holder T with the bat (11), racket, or hand is eliminated while preventing the device (10) from having an excessive length. The training device (10) preferably comprises a strap (3) attached at the proximal or distal end of the grip (2) to the shaft (4). The strap (3) may be wrapped around the wrist of the target holder T to prevent the device (10) from being thrown if the target holder T loses their hold of the grip (2) when the target (8) is hit by a bat (11).

Figure 2:
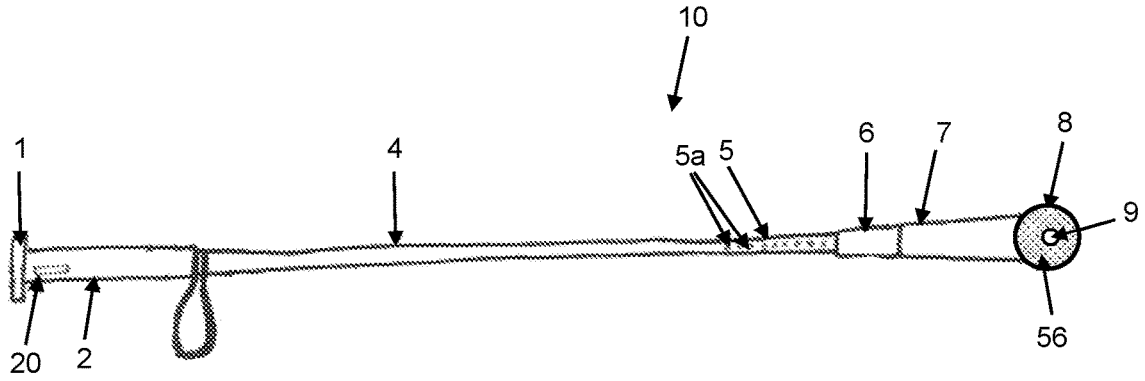
FIG. 2 is a schematic diagram of an embodiment of a bat training device.
Figure 3A:
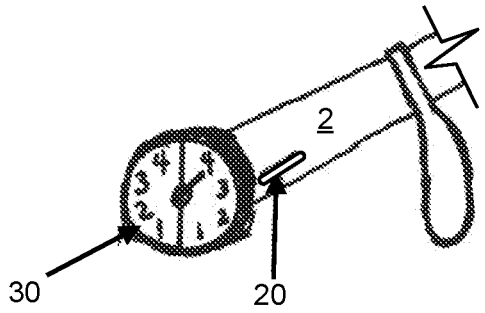
FIG. 3*a* is a schematic diagram of a proximal portion of an embodiment of a bat training device.
Figure 3B:
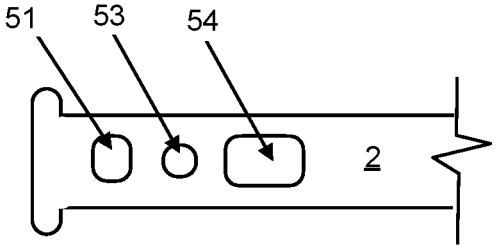
FIG. 3*b* is a cross-sectional view of a proximal portion of an embodiment of a bat training device.

Referring now to FIGS. 2-3*b*, the proximal end of the shaft (4) is preferably covered by a knob (1) that helps the target holder T keep hold of the grip (2) when the target (8) is hit. The grip (2) preferably comprises a covering material applied to the shaft (4) or to a shock absorbing material disposed between the shaft and the covering material. The knob (1) may be made from plastic, wood, fiberglass, or other suitable material. The grip (2), in the embodiments shown in FIGS. 2 and 3*a*, comprises a memory card slot (20), which receives a memory functionally coupled to a microprocessor (51). Additionally or alternatively, the grip may comprise electrical components disposed in a shock absorbing material covering the shaft (4), such as one or more batteries (54), wires, sensors, transmitters, receivers, transceivers (53), microprocessors (51), and/or piezoelectric actuators. FIG. 3*b* shows a cross-sectional view of an embodiment of the training device (10) comprising a grip (2) comprising a microprocessor (51), transceiver (53), and battery (54). These components are functionally coupled such that the battery(ies) powers the microprocessor (51), transceiver (53), and an accelerometer (52) in the target (8) of the device. The accelerometer (52) transmits, wirelessly or by wires, data to the microprocessor (51), which may transfer data via card slot (20) to a memory card and/or to a remote computing device (61,62).

The device (10) may comprise a user interface (30), an embodiment of which is shown in FIG. 3*a* as being located on the proximal face of the knob (1). The user interface (30) may be embodied as a dial, touch screen, knob, keypad, or switch, for example. A user interface is functionally coupled to a microprocessor (51), accelerometer (52), and/or a feedback mechanism such as one or more LEDs (5*a*, 11) and/or a sound generator (12) and/or a haptic piezoelectric actuator. The user interface (30) may be configured to allow a user to turn the device power on and off, to set a sensitivity of one or more feedback mechanisms, command the microprocessor to transmit data wirelessly to a remote computing device (61,62), clear data stored in on-board memory and/or memory on a memory card, or to write data to a memory card. For example, to change response of one or more LEDs (5*a*, 11) to data received from the microprocessor (51), the user interface (30) may be functionally coupled to the microprocessor (51) to alter a threshold value for acceleration data from an accelerometer (52) required to signal one or more LEDs (5*a*, 11) to illuminate. In another embodiment, the user interface (30) may be functionally coupled to the microprocessor (51) to change a current or voltage from a piezoelectric generator (55) sufficient to illuminate a LED (5*a*, 11).

The distal end of the shaft (4) is attached to a target (8) which, in this embodiment, has the size and shape of a baseball. It is preferred that the target (8) also has a feel and mass as similar to a baseball as possible so that the ball hitter B experiences a direct physical feedback similar to that with an actual baseball. For example, the target may have the composition of a baseball with the exception of a hole having a cross-sectional shape and size for receiving the shaft (4), which may be fixed to the target using adhesive or complementary metal sleeves attached to the shaft (4) and target (8) that attach by a clamp, clasp, or screw mechanism. Additionally or alternatively, the shaft (4) may comprise a central open channel and a cord may run centrally through the central channel from the knob (1) to the target (8) and attach to both. The target (8) may comprise an indicator (9) positioned to be visible by the target holder T and/or the ball hitter B (FIGS. 1 and 2) as an aid to consistent positioning of the device (10). The indicator (9) may be a passive indicator such as a region of color contrasting with the color of the target or an active indicator such as a light emitting diode (LED). Embodiments for other ball hitting sports preferably have targets as similar in size, shape, mass, and feel to the ball used in the sport and this may be achieved in a similar manner as with a baseball embodiment. For volleyball and tennis training embodiments, a seal between the target (8) and shaft (4) or other component attached to the shaft to which the target is attached is required to maintain a sealed air chamber as with the ball used in the respective sport.

Figure 4:
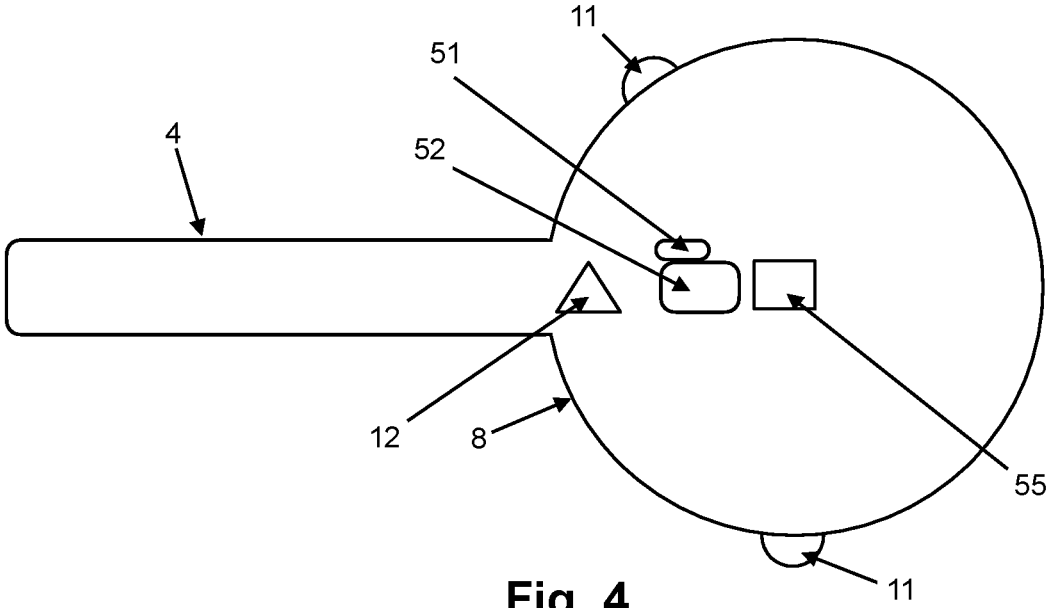
FIG. 4 is a schematic diagram of a distal portion of an embodiment of a bat training device.

An active indicator (9) may illuminate in response to a signal from an accelerometer (52) or a microprocessor (51) receiving data from an accelerometer (52). The accelerometer (52) is preferably a micro-electro-mechanical (MEMS) accelerometer located in the target (8) that provides simultaneous acceleration measurements in 3 axes. In addition to the acceleration of the target (8), the accelerometer (52) senses the acceleration due to gravity so that the orientation of the target (8) need not be identical for each hit. The active indicator (9) may change color depending on the region of the target (8) contacted by the bat (11). For example, the active indicator may comprise LEDs that provide a green light when the target is contacted in a desired region, yellow when contacted toward the top of the target, and red when contacted toward the bottom of the target. In addition to an accelerometer (52), the target may comprise an array of sensors (56) capable of detecting a point of contact between the bat (11) and the target (8) (FIG. 4). For example, the sensors may be light sensors that detect the absence or reduction of light caused by the bat (11) making contact with the surface of the target (8). Alternatively the sensors (56) may be pressure sensors that detect the impact of the bat (11). Because the accelerometer (52) provides a means for determining the direction of gravity, the orientation of each sensor (56) on the target (8) may be known and correlated with the direction of acceleration of the target (8) when it is hit.

Immediately proximal to the target (8), the device (10) comprises an insulation segment (7) for insulating this portion of the device (10) from impacts of a bat (11) or racket. In another embodiment, for example for volleyball practice, the insulation segment may additionally insulate a striking hand, wrist, or arm from being injured by the shaft (4). It is also possible to modify the invention such that the shaft (4) dispensed with so that the target (8) and optionally the insulating segment (7) is suspended by elastic bands extending in two or more directions and attached a distance from the target (8) and to fixed attachment points. For embodiments having only a target and no other segments or shaft (4), all electronic components are suspended inside or on the target (8) and are as light weight as possible. The insulating segment (7) comprises a protective covering comprising a resilient material that does not break or crack when struck by the bat (11) and a shock absorbing material between the protective covering and the shaft (4). Examples of resilient materials include durable plastics such as a PVC, an acrylic and a polycarbonate, composite materials such as a fiberglass and a carbon fiber, steel, aluminum, wood, and bamboo. Examples of shock absorbing materials include cork, paperboard composite honeycomb structures, expanded polystyrene, expanded polypropylene, expanded polyethylene, expanded polyurethane, expanded starch, inflated air cushions, and molded pulp. The protective covering and shock insulating materials may be embodied as two or more layers fused to one another or as separate layers attached to one another, and may be attached to the shaft (4) by means of adhesive, staples, straps, or clamps. Additionally or alternatively, the insulation segment (7) may be held in place by compression between the target (8) and an access segment (6).

An access segment (6) may be positioned immediately proximal to the insulation segment (7). An access segment may provide a means for detaching the target (8) and/or insulation segment (7) from the proximal portion of the shaft (4). For example, the shaft (4) may comprise a proximal section and a distal section that are reversibly connected at the proximal or distal end of the access segment (6) by a quick release clamp, screw attachment, clip, or other commonly use means for reversible attachment. For example, the distal end of the access segment (6) and the proximal end of the insulation segment (7) may each comprise a metal plate. The two metal plates comprise complementary attachment components for a screw, clamp, pin, or clasp. Additionally or alternatively, the access segment (6) may comprise a removable durable cover covering a shock absorbing material in which one or more electrical components are located. Electrical components may include one or more batteries (54), wires, sensors, transmitters and receivers (53), microprocessors (51), and/or piezoelectric generators (55).

The training device (10) may comprise an illumination region (5) comprising LEDs (5*a*) or other lights disposed on the shaft (4) and functionally coupled to an accelerometer (52) to provide visual feedback in response to an impact of a bat (11) on the target (8). For example, the illumination region (5) may comprise a series of LEDs (51), the number of which illuminate in correlation with a magnitude and/or direction of an acceleration measured by the accelerometer. The correlation between the magnitude of the measured acceleration and the number of LEDs (5*a*) that illuminate may be controlled via the user interface (30). LEDs (5*a*) may illuminate with different colors depending on an upward or downward component of the measured acceleration. Additionally or alternatively, a sound emitter (12) positioned in the target (8), grip (2), access section (6), or disposed on the shaft (4) may emit a sound having a pitch and/or volume that provides feedback regarding a strike on the target (8). For example, the sound emitted may be louder as the magnitude of the measured acceleration increases and the pitch may be higher or lower depending on an upward or downward component of the measured acceleration. Additionally or alternatively, indicator LEDs (11) may be arranged on, or visibly under the surface of, the target (8) and illuminate in response to measured accelerations. These may be arranged on a portion of the target facing the target holder T and/or a portion of the target facing the ball hitter B.

It is preferred that the accelerometer (52) be positioned in the target (8) or on a portion of the shaft (4) in or near the target (8). The accelerometer (52) preferably measures acceleration in three different planes and communicates with a microprocessor (51) that processes and stores timed accelerometer data. A microprocessor may be incorporated into the accelerometer (52) or the microprocessor (51) may be remote to the accelerometer, being located, for example, in the grip (2) or access section (6) of the device (10). While other electrical components may be disposed in or near the target (8), it is preferred that other electrical components be disposed elsewhere in the training device (10). Minimizing physical differences between the target (8) and a baseball is made more difficult by the placement of electronics that have different densities, or distribution of density, from materials in a baseball. Wireless communication between the accelerometer, processor, and LEDs is preferred to avoid the need for wires running the length of the shaft (4).

The training device (10) may be configured as a stand alone device that provides immediate feedback to a ball hitter using lights and/or sounds to indicate whether the ball hitter B has hit the ball on a surface that may be associated with a ball trajectory and/or a body posture. For example, the magnitude of vertical acceleration in an upward direction may indicate that the target has been hit on a bottom third of the target (8), which can be associated with a resulting chip or fly ball and dropping a shoulder during the swing. The magnitude of vertical acceleration in a downward direction may indicate that the target has been hit on a top third of the target (8), which can be associated with a ground ball and a downward component to the swing. The magnitude of lateral acceleration in a horizontal direction may indicate that the target has been hit on a lateral third of the target (8), which can be associated with a foul ball. The overall magnitude of acceleration may indicate the magnitude of energy transferred to the target (8) which, together with the direction of acceleration, can be associated with a distance a ball would have traveled. Feedback regarding the regions of the target (8) contacted and with what force may be indicated by the number and/or color of lights or LEDs (5*a*, 11) illuminated and/or by a pitch and/or volume of sound from a sound emitter (12).

Figure 5:
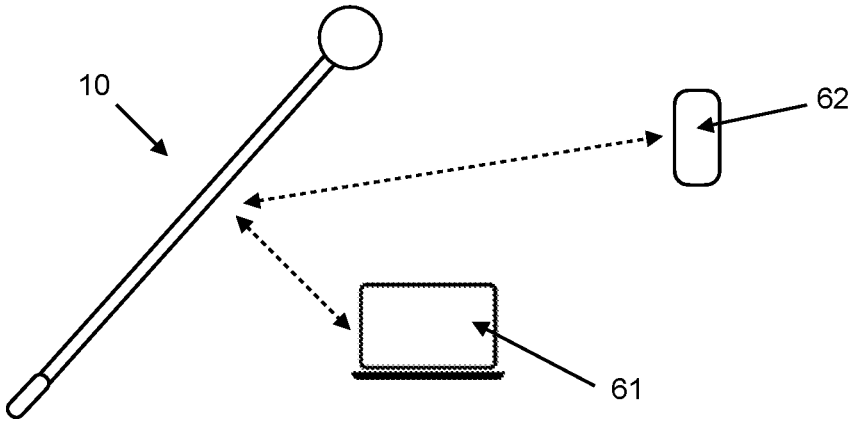
FIG. 5 is a schematic of an embodiment of a bat training system.
Figure 6:
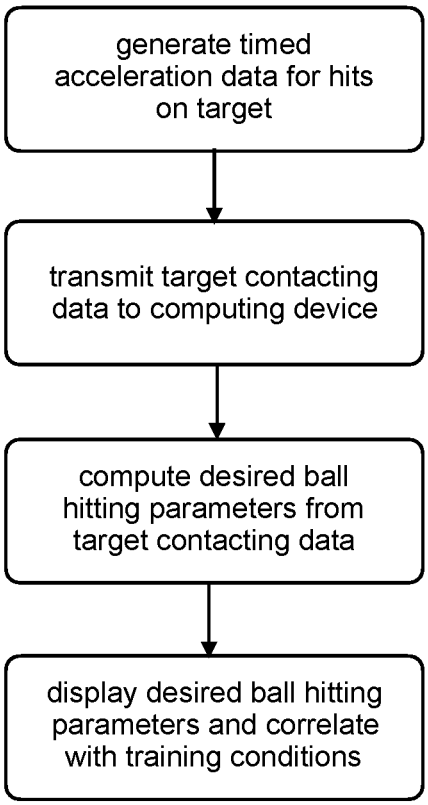
FIG. 6 is a flowchart showing methods steps for a training method.

A training system comprises a training device (10) that communicates wirelessly, or by wire, with a computing device such as a laptop computer (61) or mobile phone or tablet (62) (FIG. 5). Timed accelerometer data from individual hits on the target (8) are transferred from the device (10) to the computing device by wireless transmission or transfer of a memory card, for example. The computing device comprises training software that receives the timed accelerometer data and performs computations using data from individual hits to compute ball hitting parameters, including one or more of a projected trajectory, a location on the target (8) contacted by the bat (11), a total energy transferred to the target (8), a path of the bat (11) approaching the target (8), and a posture of the ball hitter producing the computed path of the bat. If the training device (10) comprises an array of sensors (56), sensor data including position on the target (8) contacted by the bat (11) are transferred to the computing device and may be fused with accelerometer data to refine the calculated the location on the target (8) contacted by the bat (11).

The training software is programmed to provide displays of ball hitting parameters over time by indicating via the display, how ball hitting parameters change with training conditions such as cumulative training time, training time during a training session, bat type, stance, etc. For example, a display may show a bar graph of energy transferred to the target for hits during a single training session or over a longer period of time such as days, weeks, or months. Another example is a series of animations of calculated ball trajectories during a single training session or a series of animations of averaged calculated ball trajectories for a series of training sessions. Animations or other graphic representations of computed path of the bat and/or ball may be compared from hits with the ball hitter using different bats or in different stances to assess batting technique. Batting technique including stance, bat used, duration of warm ups, and hand position on the bat may be adjusted based on displayed ball hitting parameters correlated with these training conditions to improve batting performance.

The training software may comprise a control module programmed to send signals to the microprocessor (51) to control functions of the training device (10). For example, the signals sent to the microprocessor (51) may alter a threshold value for acceleration data from the accelerometer (52) required to signal one or more LEDs (5*a*, 11) to illuminate, change a current or voltage from a piezoelectric generator (55) sufficient to illuminate a LED (5*a*, 11), initiate transfer of data to the computing device, turn the device on or off, clear data stored on the microprocessor (51) or storage media on the device, and/or wake or set to sleep the device (10).

The invention claimed is:

1. A ball hitting practice device comprising:
a flexible shaft;
a grip at a proximal end of the shaft;
a target a distal end of the shaft;
an accelerometer functionally coupled to a microprocessor and a feedback means;
a battery powering the accelerometer and microprocessor; and
an insulating section immediately proximal to the target wherein:
the accelerometer is disposed in the target or the insulating section and the feedback means comprises a visible indicator, an audible sound generator, a haptic vibration, or any combination of these and said feedback means generates a feedback dependent upon acceleration data from the accelerometer.

2. The device of claim 1, wherein the feedback means is disposed in or on the device.

3. The device of claim 1, further comprising an illumination region proximal to the insulation section, said illumination region comprising a plurality of LEDs that illuminate in response to a magnitude of acceleration measured by the accelerometer.

4. The device of claim 1, wherein the target comprises an active or a passive indicator.

5. The device of claim 4, wherein the active or passive indicator is an active indicator comprising a LED that illuminates in response to an acceleration measured by the accelerometer.

6. The device of claim 1, wherein the shaft comprises sections reversibly attached at a point proximal to the insulation section.

7. The device of claim 1, further comprising a user interface functionally coupled to the microprocessor and the feedback means.

8. The device of claim 1, further comprising a flash drive functionally coupled to the microprocessor and configured to store data received from the microprocessor.

9. The device of claim 1, wherein the microprocessor is functionally coupled to a receiver that receives data from the accelerometer and from a user interface and wherein the microprocessor is functionally coupled to a transmitter that is configured to send data to a remote computing device.

10. The device of claim 1, wherein the target comprises an array of sensors configured to detect contact with a bat and said array of sensors is functionally coupled to the microprocessor and configured to transmit sensor data to the microprocessor.

11. The device of claim 1, wherein the target is sized and shaped as a baseball, a softball, a cricket ball, a tennis ball, or a volleyball.

12. The device of claim 1, wherein the shaft is curved.

13. A ball hitting practice system comprising the device of claim 9 and the remote computing device, said remote computing device comprising a display and training software that receives timed accelerometer data from the device and performs computations using data from individual target hitting events to compute a ball hitting parameter and display representations of said ball hitting parameter.

14. The ball hitting practice system of claim 13, wherein the training software is programmed to display a change in a ball hitting parameter over time correlated with a training condition.

15. The ball hitting practice system of claim 14, wherein the target is sized and shaped as a baseball, a softball, or a cricket ball and the ball hitting parameter comprises one or more of: energy transferred from a bat to the target, calculated ball trajectory, computed path of a bat striking the target, and a location on the target struck by a bat.

16. The ball hitting practice system of claim 14, wherein the training condition comprise one or more of a stance, a bat type, a warm-up duration, and a hand position on a bat.

17. The ball hitting practice system of claim 13, wherein the training software comprises a control module programmed to control functions of the training device via signals sent from the computing device to the microprocessor.

18. The ball hitting practice system of claim 17, wherein the signals sent to the microprocessor alter a threshold value for acceleration data from the accelerometer required to signal one or more LEDs to illuminate, change a current or voltage from a piezoelectric generator sufficient to illuminate a LED, initiate transfer of data from the practice device to the computing device, turn the device on or off, clear data stored on the microprocessor or a storage media on the practice device, and/or wake the practice device from a sleep mode or set the practice device to a sleep mode.

* * * * *